US008684506B2

(12) United States Patent
Barker et al.

(10) Patent No.: US 8,684,506 B2
(45) Date of Patent: Apr. 1, 2014

(54) APPARATUS AND METHOD FOR COLLECTING AND EXPELLING PHASE CHANGE INK IN A PRINTER

(75) Inventors: Laurence S. Barker, Fairport, NY (US); Michael Quoc Lu, Fairport, NY (US); John R. Uchal, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 275 days.

(21) Appl. No.: 13/219,962

(22) Filed: Aug. 29, 2011

(65) Prior Publication Data

US 2013/0050361 A1 Feb. 28, 2013

(51) Int. Cl.
*B41J 2/175* (2006.01)
*B41J 2/185* (2006.01)

(52) U.S. Cl.
USPC ..... 347/88; 347/90

(58) Field of Classification Search
USPC ..... 347/88, 90
See application file for complete search history.

(56) References Cited

U.S. PATENT DOCUMENTS 5,184,147 A 2/1993 MacLane et al.
5,331,344 A * 7/1994 Miyagawa et al. ..... 347/65
5,557,306 A 9/1996 Fukushima et al.
5,914,735 A * 6/1999 Yamamoto et al. ..... 347/33
5,949,448 A 9/1999 Man et al.
6,145,958 A 11/2000 Medin et al.
6,189,999 B1 * 2/2001 Pham et al. ..... 347/33
6,244,683 B1 6/2001 Alvarez et al.
7,040,734 B2 * 5/2006 Nakashima et al. ..... 347/33
7,455,387 B2 11/2008 Cunnington et al.
2001/0012027 A1 8/2001 Murcia et al.
2007/0076048 A1 4/2007 Cunnington et al.
2009/0102906 A1 4/2009 Phillips et al.
2010/0220145 A1 9/2010 Koehler et al.
2010/0238227 A1 9/2010 Nystrom et al.

* cited by examiner

*Primary Examiner* — Matthew Luu
*Assistant Examiner* — Alexander D Shenderov
(74) *Attorney, Agent, or Firm* — Maginot, Moore & Beck, LLP

(57) ABSTRACT

An ink removal system includes a drip bib and a flexible member. The drip bib collects melted ink flowing down the face of a printhead and the flexible member captures ink dropping from the drip bib after an ink receptacle has received most of the ink collected by the drip bib. When the ink receptacle returns to the position where the receptacle catches melted ink from the drip bib, the receptacle also bends the flexible member and releases the captured ink, which falls into the ink receptacle.

11 Claims, 10 Drawing Sheets

APPARATUS AND METHOD FOR COLLECTING AND EXPELLING PHASE CHANGE INK IN A PRINTER

TECHNICAL FIELD

This disclosure relates generally to imaging devices that eject phase change ink to form images on print media, and, more particularly, to devices that clean phase change ink from printheads in such printers.

BACKGROUND

In general, inkjet printing machines or printers include at least one printhead unit that ejects drops of liquid ink onto recording media or an image forming member. A phase change inkjet printer employs phase change inks that are in the solid phase at ambient temperature, but transition to a liquid phase at an elevated temperature. A mounted printhead ejects drops of the melted ink to form an ink image. The ink can be ejected directly onto print media or onto an image receiving member before the image is transferred to print media. Once the ejected ink is onto the media or image receiving member, the ink droplets quickly solidify to form an image.

During operation of the printer, printheads may emit ink that flows over a face of the printhead instead of being ejected toward the image receiving member. For example, a controller in the printer operates one or more devices to purge and clean printheads to ensure that the ink ejectors in each printhead operate efficiently. The printhead purging urges ink through the inkjet ejectors of a printhead to remove debris, air bubbles, or other contaminants from the inkjet ejectors. The purged ink emerges from the nozzles of the ejectors and flows down the front face of the printhead. A drip bib positioned beneath the front face collects the purged ink and directs the ink into an ink receptacle. The controller operates actuators to move the ink receptacle into position to receive the purged ink and, following the purging and cleaning operation, operates the actuators to return the ink receptacle to a position where the receptacle does not interfere with printing operations.

The inkjet ejectors may also release ink in response to a printhead being activated after heat has been removed from the printhead for a period of time that enables melted ink to return to the solid phase. As the heaters in the printhead heat the printhead to a temperature that melts the solidified ink, the nozzles of the inkjet ejectors may "weep" ink. This ink flows down the face of the printhead and onto the drip bib. Because no cleaning operation is being performed, the ink receptacle is not positioned beneath the printhead during activation. Consequently, vibration in the printer may release the liquid ink from the drip bib. Once the liquid ink lands on another printer component, it is likely to freeze on the image receiving member or some other printer component in the vicinity.

As noted above, printheads typically include a drip bib positioned below each printhead. The lower edge of the drip bib tapers to one or more channels or points where ink collects prior to dripping into the receptacle. Although most of the purged ink falls from the collection areas of the drip bib, surface tension in a small portion of the purged ink may be sufficient to retain ink on the drip bib after the ink receptacle is no longer positioned below the drip bib. On occasion, this residual liquid ink may break free from the drip bib and land on a printer component. In some cases, the frozen ink may adversely affect the printer component on which the ink lands. Thus, more efficient removal of ink from drip bibs in printers using phase change ink is desirable.

SUMMARY

In one embodiment, an ink removal system for a printhead that ejects phase change ink has been developed. The system includes a drip bib operatively connected to a printhead at a position below a face of the printhead to enable the drip bib to receive melted ink from the face of the printhead and direct the melted ink downward from the face of the printhead, and a flexible member positioned below the drip bib and configured to receive and capture melted ink dropping from the drip bib and to release the captured ink from the flexible member in response to the flexible member bending.

In another embodiment, A method of holding ink that is released from a drip bib has been developed. The method includes capturing liquid ink released from a drip bib in a flexible member positioned below the drip bib, bending the flexible member, and releasing the captured ink from the flexible member in response to bending the flexible member.

DETAILED DESCRIPTION

Figure 1:
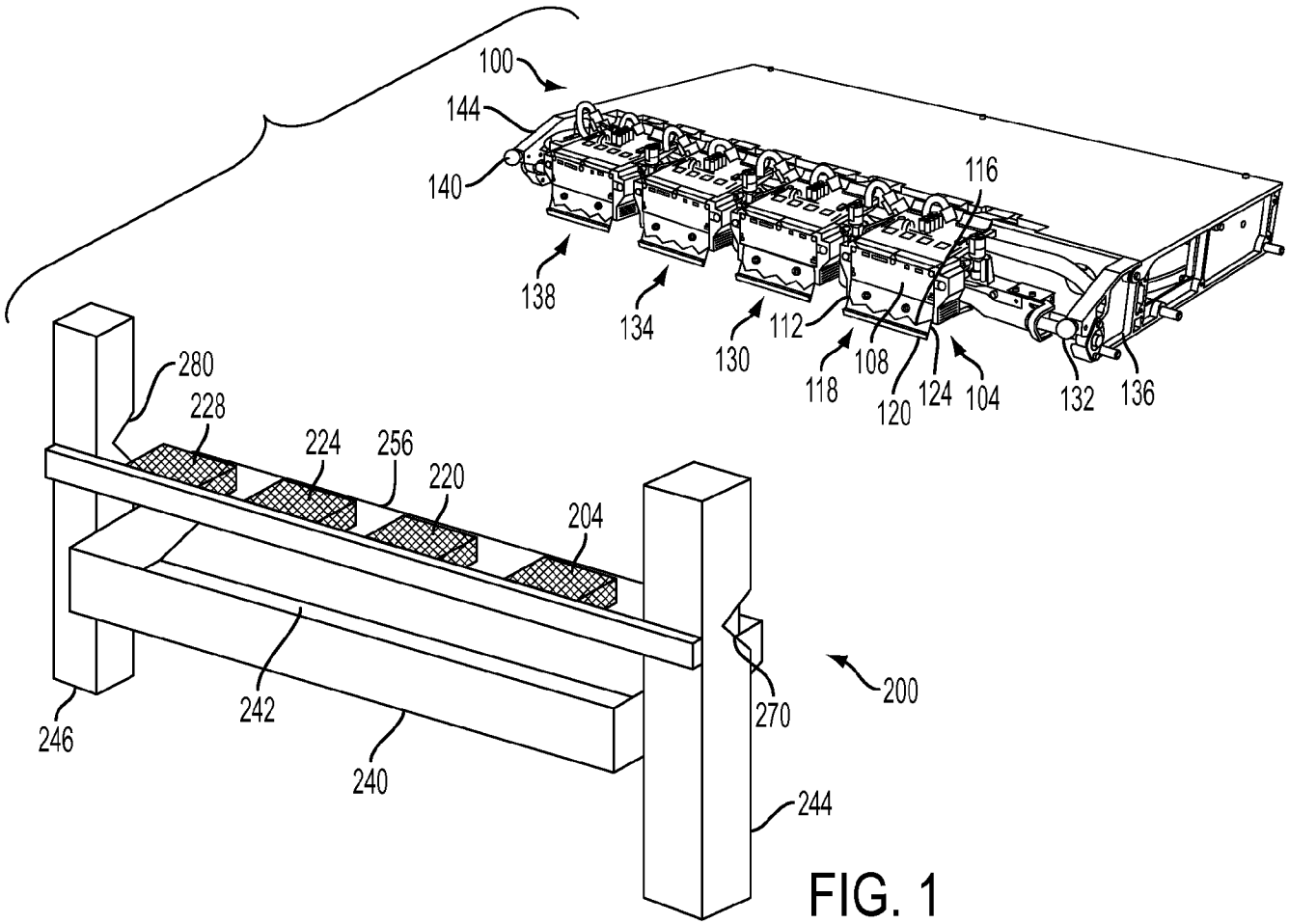
FIG. 1 is a partially exploded view of a printhead array and a cleaning unit.

For a general understanding of the environment for the system and method disclosed herein as well as the details for the system and method, reference is made to the drawings. In the drawings, like reference numerals have been used throughout to designate like elements. As used herein the term "printer" refers to any device that is configured to eject a marking agent upon an image receiving surface and include photocopiers, facsimile machines, multifunction devices, as well as direct and indirect inkjet printers. An image receiving surface refers to any surface that receives ink drops, such as an imaging drum, imaging belt, or various print media including paper.

FIG. 1 depicts a printhead array 100 and a cleaning unit 200. Cleaning unit 200 includes a housing, seen here as support rails 244 and 246 and ink receptacle 240, and printhead wiper units 204, 220, 224, and 228. Support rails 244 and 246 hold ink receptacle 240 in place and support the wiper units 204, 220, 224, and 228. Ink receptacle 240 is a container that forms a volume with a sufficient size to hold ink purged from each of the printheads in printhead array 104 during cleaning operations. The top 242 of ink receptacle 240 is open to enable ink purged from printheads in the printhead array 100 to flow into the ink receptacle 240. While cleaning unit 200 includes a single ink receptacle 240, alternative cleaning unit embodiments may employ two or more receptacles. Rails 244 and 246 include docking members 270 and 280, respectively.

Printhead array 100 includes printhead units 104, 130, 134, and 138, docking balls 132 and 140, and printhead array carriage members 136 and 144. Each printhead unit includes a printhead face and a drip bib, with printhead unit 104 shown depicting a front face 108, drip bib 112, and a flexible member 118. The printhead face 108 includes an array of ink ejectors that are configured to eject ink drops onto an image receiving surface. While printhead unit 104 is described in more detail, the printhead units 104, 130, 134, and 138 are substantially identical. A printer may include one or more printhead arrays, such as printhead array 100, that are configured to eject ink having one or more colors onto the image receiving surface.

During a purge operation, ink flows down the printhead face 108 over the drip bib 112. Drip bib 112, positioned below the printhead face 108, collects and guides ink that flows down the printhead face 108. In the embodiment of FIG. 1, drip bib 112 has a lower edge shaped with four points as exemplified by point 116. The drip bib 112 guides ink toward the four points 116 where the ink may drip from the drip bib 112 into an ink receptacle 240 in the cleaning unit 200. Alternative drip bib configurations may have different shapes including having more or fewer points to receive ink. Alternative drip bibs may additionally include channels formed in the drip bib to control the ink flow. During a purge operation, ink flowing down the drip bib 112 drips from the points 116 of the drip bib 112 and falls into the ink receptacle 240. In the embodiment of FIG. 1, drip bib 112 is formed from a metal sheet, such as stainless steel. During purging and imaging operations, the drip bib 112 heats to a temperature that maintains phase-change ink in contact with the drip bib 112 in a liquid state.

FIG. 1 depicts a flexible member 118 including an ink gutter 120 and an attachment member 124 that operatively connects the ink gutter 120 to the drip bib 112. The gutter 120 forms a volume for capturing and holding residual ink that adheres to the drip bib 112 and subsequently releases from the drip bib 112 at a time other than when the printhead array 100 is engaged with the cleaning unit 200, such as during imaging operations, during a printhead warm-up operation, or when the printheads are in a standby configuration. The flexible member 118 is formed from a thermally insulative material having a low solid surface energy such as silicone rubber. The flexible member 118 employs a thermally insulative material to enable the ink gutter 120 to maintain a temperature below the freezing temperature of phase change ink that drips from the drip bib 112. The gutter 120 captures ink and the ink freezes into a solid mass 290 held in the gutter 120. The material forming the flexible member 118 has a low solid surface energy to prevent the solidified ink from adhering to the gutter 120.

In the configuration of FIG. 1, flexible attachment member 124 holds flexible member 118 in a position below the drip bib 112 to receive and capture ink drops that are collected and released from the drip bib 112. The flexible attachment member 124 enables the gutter 120 to move between different positions during operation. The flexible attachment member 124 and gutter 120 may be formed from a single material, or may be separate members that are joined together to form the flexible member 118. As seen in more detail below, the gutter 120 is further configured to engage the ink receptacle 240 in cleaning unit 200. The engagement moves the flexible member 118 to a position that enables solidified ink held in the gutter 120 to empty into the receptacle f240 during purge operations. The flexible attachment member 124 returns the gutter 120 to the position under the drip bib 112 when the printhead unit 104 disengages from the cleaning unit 200.

Figure 6:
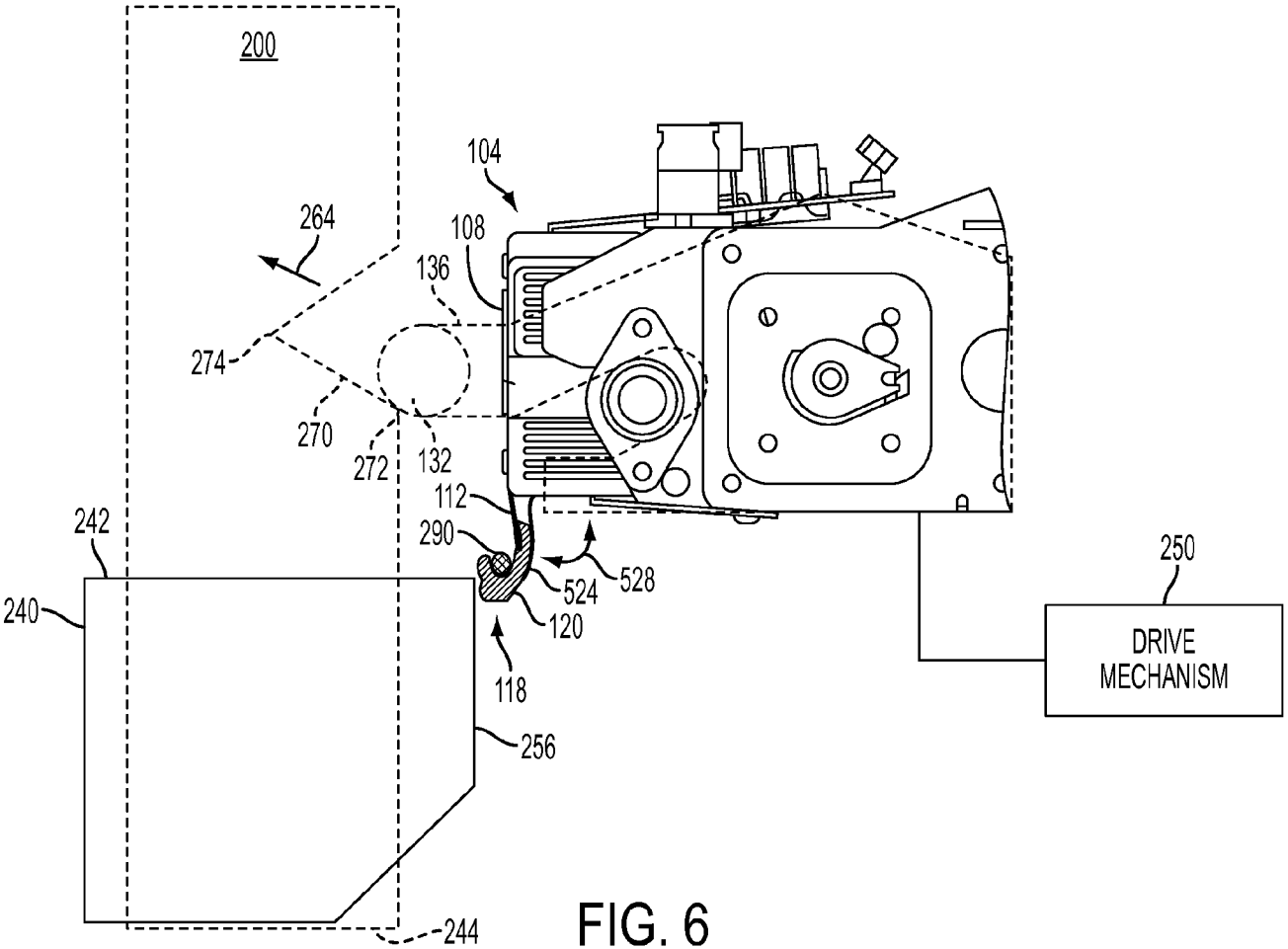
FIG. 6 is a side view of an alternative configuration of the printhead unit of FIG. 1 including a biasing member engaging the flexible member.

FIG. 6 depicts an alternative configuration of the printhead unit 104 that includes a return spring 524 that engages the flexible member 118 on the opposite side of the drip bib 112. Spring 524 is depicted as a leaf spring with one end affixed to the printhead unit 104 and a second end engaging the flexible member 118. Alternative types of springs including coil springs may engage the flexible member 118 as well. Spring 524 biases the flexible member 118 to a position that enables the gutter 120 to receive ink drops released from the drip bib 112 during imaging and standby operations. Spring 524 may flex as shown by arrows 528 when the flexible member 118 engages the ink receptacle 240. Spring 524 returns the flexible member 118 to the position seen in FIG. 6 when the printhead unit 104 disengages from the cleaning unit 200.

Referring again to FIG. 1, the printhead array 100 is configured to engage with cleaning unit 200 for cleaning operations. Carriage members 136 and 144 guide the printhead array 100 and docking balls 132 and 140 engage docking members 270 and 280, respectively. Each docking ball is configured to slide into a fully engaged position with the corresponding docking member in the cleaning unit. Wiper units 204, 220, 224, and 228 are secured to the support rails 244 and 246 and are positioned to wipe the faces of printheads 104, 130, 134, and 18, respectively, when printhead array 100 is engaged to the docking members 270 and 280. Typical docking members include triangular or conically shaped indentations formed in support members that are arranged along either side of an ink receptacle or an image receiving surface. While support rails 244 and 246 and ink receptacle 240 form the housing for the cleaning unit 200, the housing may be any suitable structure that secures the cleaning unit components and enables the cleaning unit to engage with a printhead array for cleaning operations.

The ink receptacle 240 is configured to receive ink from the printhead array 100 through the open top 242. During purge operations, ink flows through some or all of the ink ejectors and flows down printhead face 108 instead of being ejected toward an image receiving surface in the form of ink drops. In some printhead embodiments, the printhead generates a positive pressure in an internal ink reservoir to enable ink to flow through the aperture nozzles comprising the printhead array of each printhead unit. When engaged with the cleaning unit 200, the gutter in each printhead unit, such as gutter 120 in printhead unit 104, is repositioned to enable ink flowing down the drip bib 112 to enter the ink receptacle 240 directly instead of flowing into the gutter 120.

Figure 2:
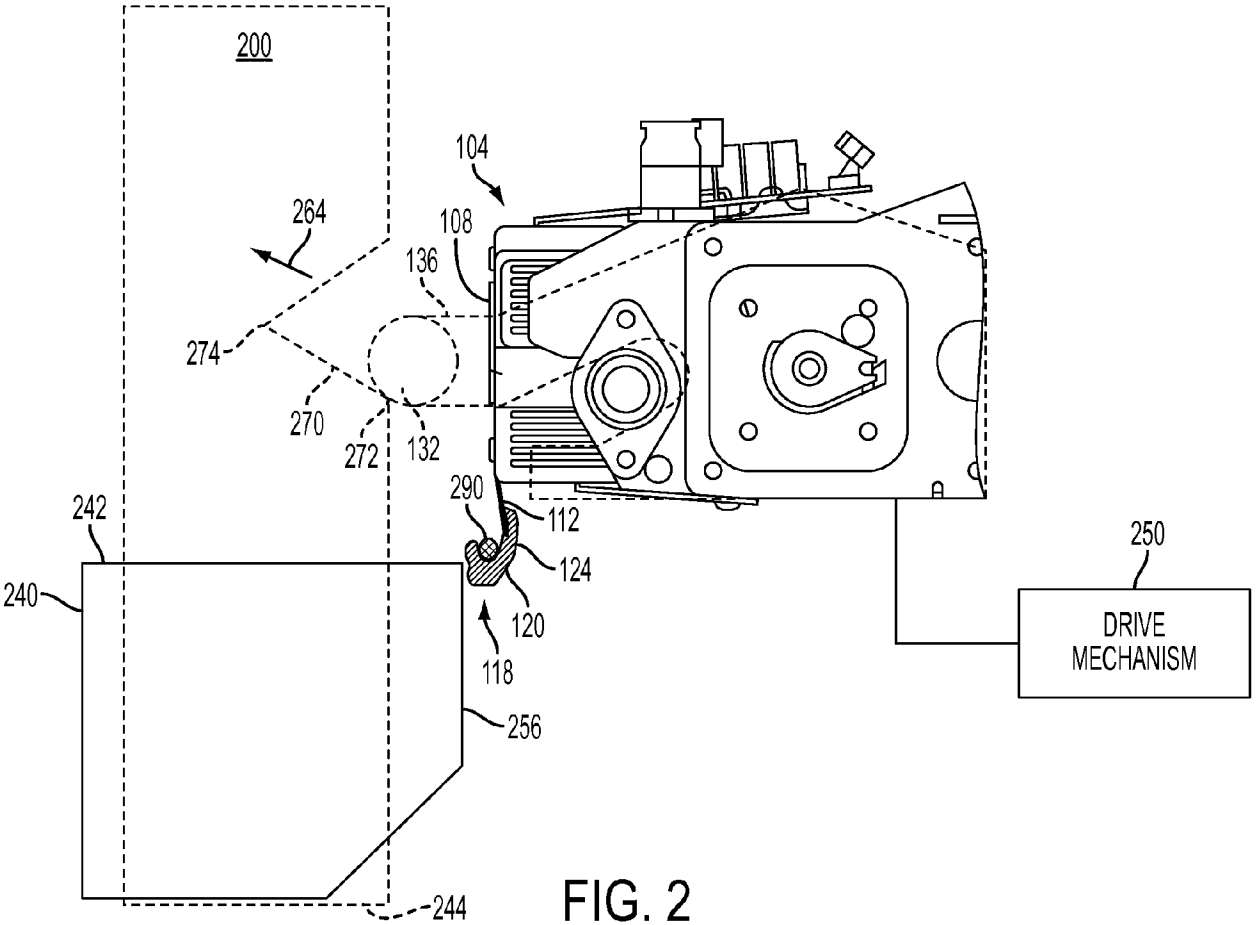
FIG. 2 is a side view of a printhead unit including a flexible member that is operatively connected to a drip bib prior to engaging with a cleaning unit during a cleaning process.
Figure 3:
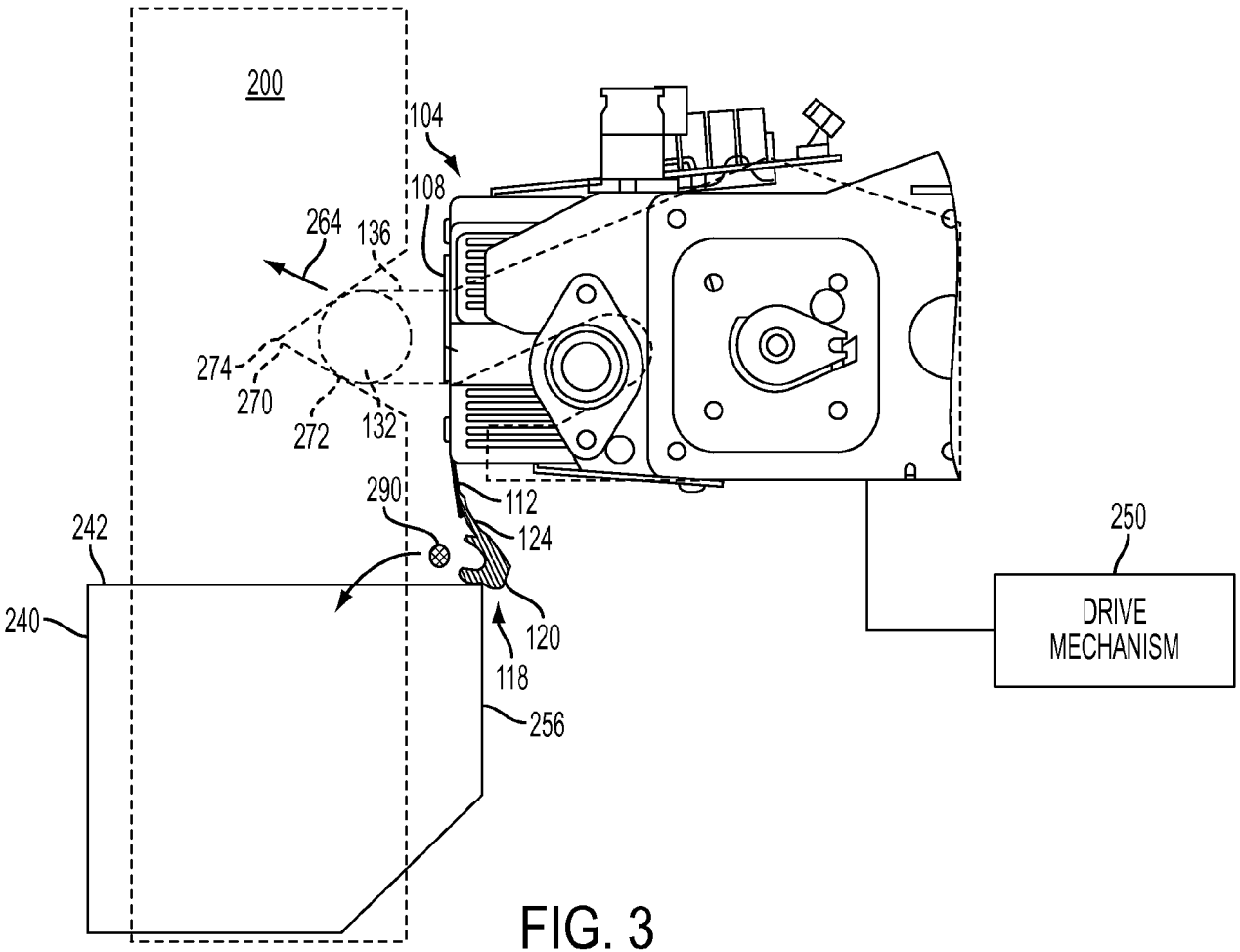
FIG. 3 is a side view of the printhead unit in FIG. 2 when engaged with the cleaning unit.

FIG. 2 and FIG. 3 depict a side view of the printhead unit 104 when disengaged and engaged, respectively, with the cleaning unit 200. Cleaning unit 200 includes a docking member 270 in the housing guide rail 244 positioned on one side of ink receptacle 240. Docking member 270 includes lower end 272 at the opening of the docking member 270 and an upper end 274. Carriage member 136 holds printhead unit 104, which includes a printhead face 108 and drip bib 112, in position. Printhead unit 104 may be one printhead in an array of printheads as depicted in FIG. 1. Carriage member 136 and docking ball 132 are configured to guide printhead unit 104 to engage with docking member 270.

In the configuration of FIG. 2, docking ball 132 engages a lower end 272 of docking member 270. A driving mechanism 250 is operatively connected to the carriage 136, docking ball 132, and printhead unit 104. Typical embodiments for drive mechanism 250 include electric motors coupled to the printhead array using gears or pulleys, hydraulic and pneumatic actuators, or any other mechanism configured to reposition printheads in the printer. The drive mechanism 250 moves the docking ball 132, carriage 136, and printhead unit 104 towards the ink receptacle. As the docking ball slides along docking member 270, printhead unit 104 begins to move in direction 264. In the position of FIG. 2, printhead face 108, drip bib 112 and the flexible member 118 are positioned outside of a front wall 256 of the ink receptacle 240. The flexible attachment member 124 biases the gutter 120 into a position under the drip bib 112 to capture ink drops released from the drip bib 212. FIG. 2 omits a side wall formed in the gutter 120 to depict a solidified ink mass 290 held in the flexible member 118. The ink forming the solidified ink mass 290 is released from the drip bib 112 into the gutter 120 during a normal printing operation. Under other conditions, the gutter 120 may be empty or hold two or more separate ink masses.

FIG. 3 depicts printhead unit 104, carriage 136, and docking ball 132 engaged with docking member 270. Docking ball 132 is shown engaged with docking member 270, although the docking ball 132 does not establish direct contact with the upper end 274 in the embodiment of FIG. 3. In the position of FIG. 3, printhead face 108 and drip bib 112 are both positioned over the opening 242 of ink receptacle 240 inside of the front wall 256. Printhead unit 104 may undergo a cleaning operation that includes purging ink through ink ejectors in printhead face 108. The purged ink flows down printhead face 108 and drip bib 112 directs the ink into ink receptacle 240 through opening 242. In some printers, the cleaning process also includes a wiper assembly (not shown) that wipes the printhead face 108 to clean contaminants and ink from the printhead unit 104. When the printhead unit 104 is engaged with the cleaning unit 200, the gutter 120 engages the front wall 256 of the ink receptacle 240. The gutter 120 is repositioned to enable purged ink flowing down the drip bib 112 to drip into the ink receptacle 240 directly.

In the configuration of FIG. 3, the gutter 120 engages the front wall 256 of the ink receptacle 240. The front wall 256 urges the flexible member 118 into the position seen in FIG. 3 where the solidified ink mass 290 is released from the gutter 120 and enters the ink receptacle 240. The low solid surface energy material used to form the gutter 120 prevents the ink mass 290 from adhering to the flexible member 118. In the configuration of FIG. 2 and FIG. 3, the gutter 120 is positioned so that a portion of the gutter 120 engages the front wall 256 as the printhead array 100 engages the cleaning unit 200. In another configuration, the ink receptacle 240 may include a projection or other structural feature that is positioned to engage the gutter 120. When the printhead unit 104 disengages from the cleaning station 200, the flexible attachment member 124 returns the gutter 120 to a position under the drip bib 112 as seen in FIG. 2.

Figure 4:
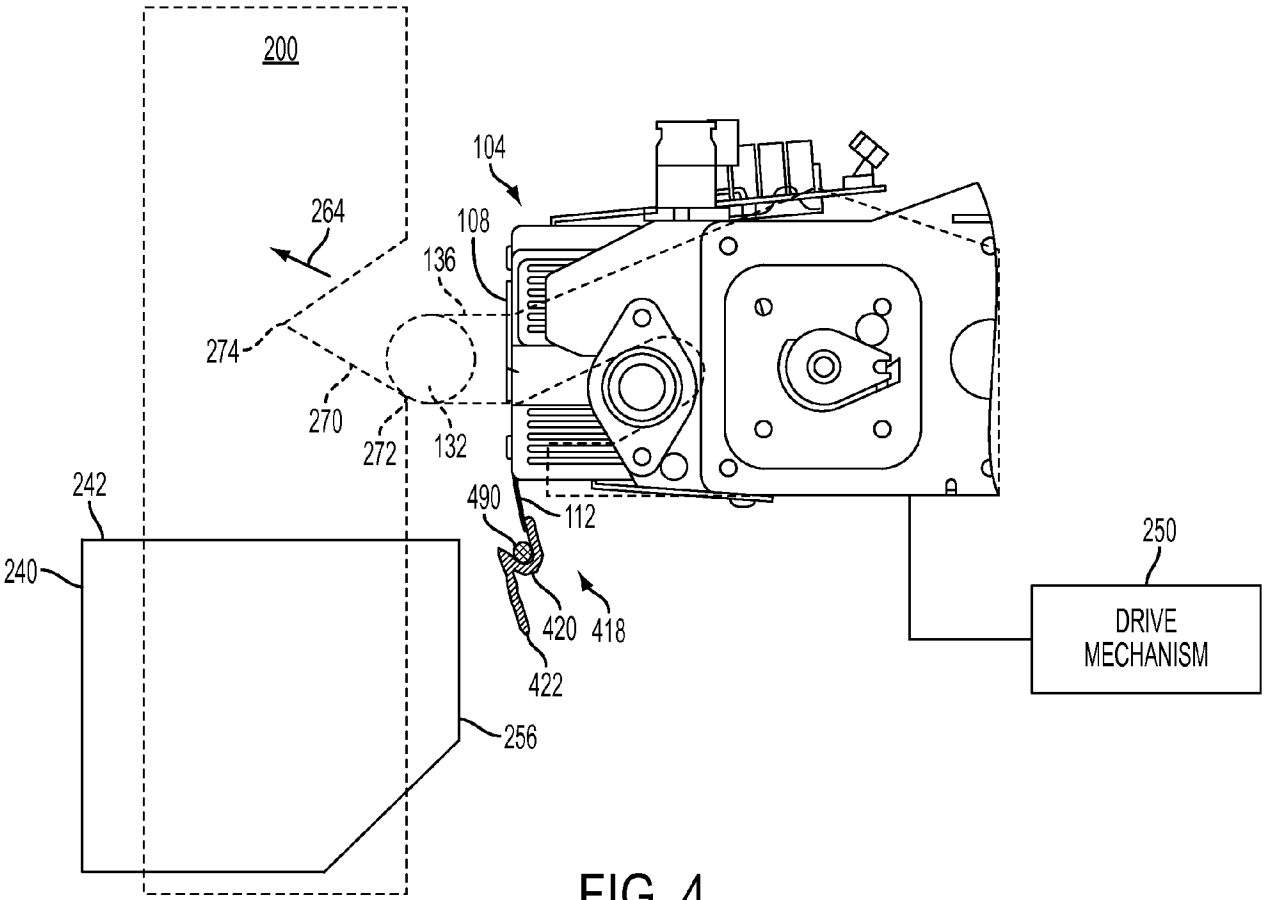
FIG. 4 is a side view of a printhead unit including another embodiment of a flexible member that is operatively connected to a drip bib prior to engaging with a cleaning unit during a cleaning process.
Figure 5:
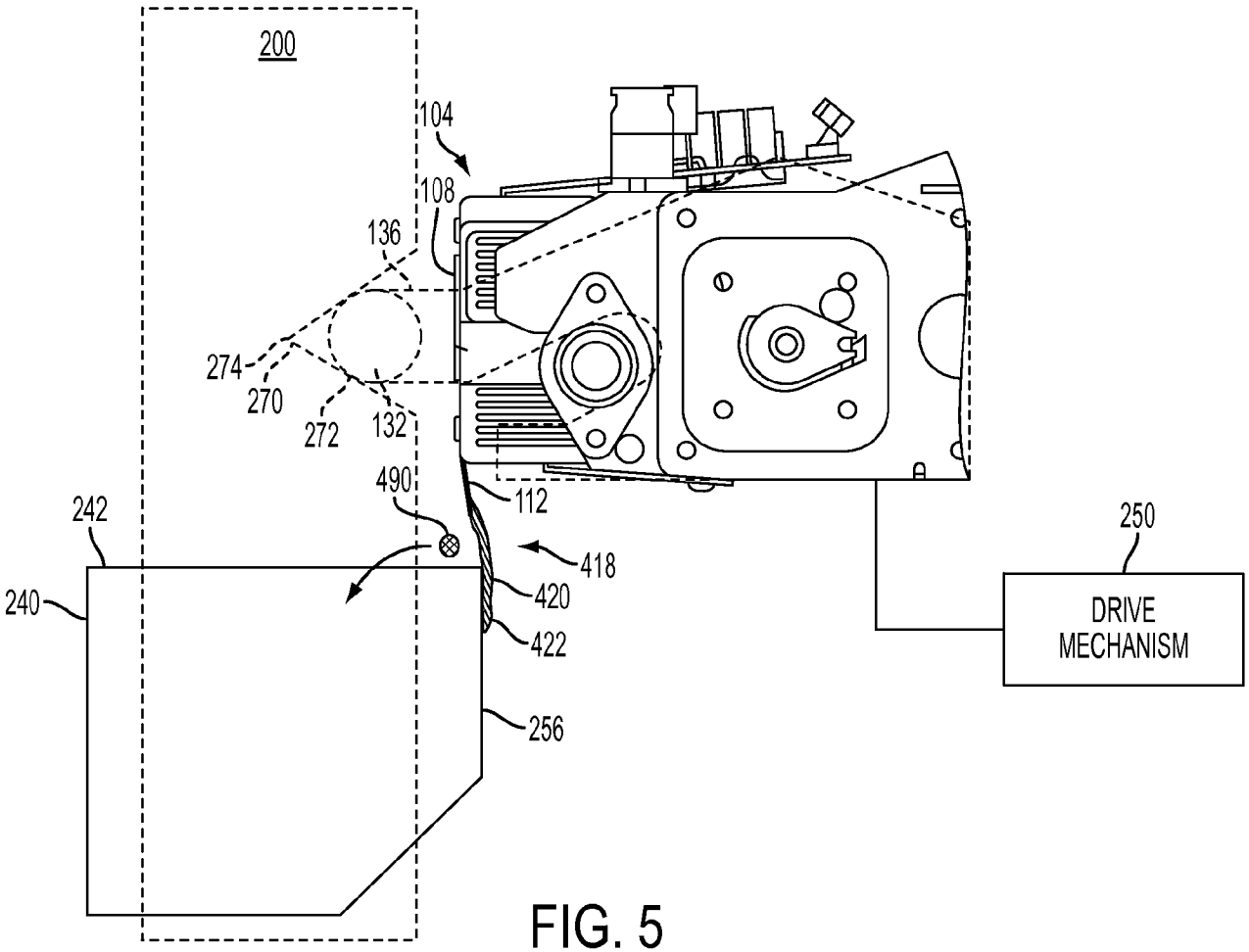
FIG. 5 is a side view of the printhead unit in FIG. 4 when engaged with the cleaning unit.

FIG. 4 and FIG. 5 depict the cleaning unit 200 and printhead unit 104 including an alternative embodiment of a flexible member 418 that is operatively connected to the drip bib 112. FIG. 4 depicts the printhead unit 104 disengaged from the cleaning unit 200. The flexible member 418 is a deformable layer of a resilient material that is positioned and shaped to form a gutter 420 that holds ink captured from the drip bib 112. The gutter 420 in the flexible member 418 holds a solidified ink mass 490 in FIG. 4. The material used to form the flexible member 418 is thermally insulative to enable ink captured from the drip bib 112 into the gutter 420 to solidify. The material forming the flexible member 418 also has a low solid surface energy to prevent the solidified ink mass 490 from adhering to the flexible member 418.

In FIG. 4, the docking ball 132 of the printhead unit 104 is positioned at one end 272 of the docking member 270. The drive mechanism 250 drives the printhead unit 104 in direction 264 to engage the cleaning unit 200 as seen in FIG. 5. In FIG. 5, a lower end 422 of the flexible member 418 engages the front wall 256 of the ink receptacle 240. The flexible member 418 bends and stretches as the print unit 104 engages the cleaning unit 200, with the lower end 422 remaining in contact with the front wall 256 of the ink receptacle 240 as the print unit 104 engages the cleaning station 200. In the stretched configuration, the gutter 420 bends and the flexible member 418 releases the solid ink mass 490. The solid ink mass 490 subsequently enters the ink receptacle 240. Additionally, in the configuration of FIG. 5, the drip bib 112 is positioned over the ink receptacle 240 to enable purged ink to flow from the drip bib 112 into the ink receptacle 240 directly. After a cleaning operation is completed, the actuator 250 disengages the printhead unit from the cleaning unit 200 as seen in FIG. 4. The lower end 422 of the flexible member 418 disengages from the ink receptacle 420 and the flexible member 418 returns to the shape seen in FIG. 4 that enables the gutter 420 to receive and capture ink drops that are released from the drip bib 112.

Figure 7:
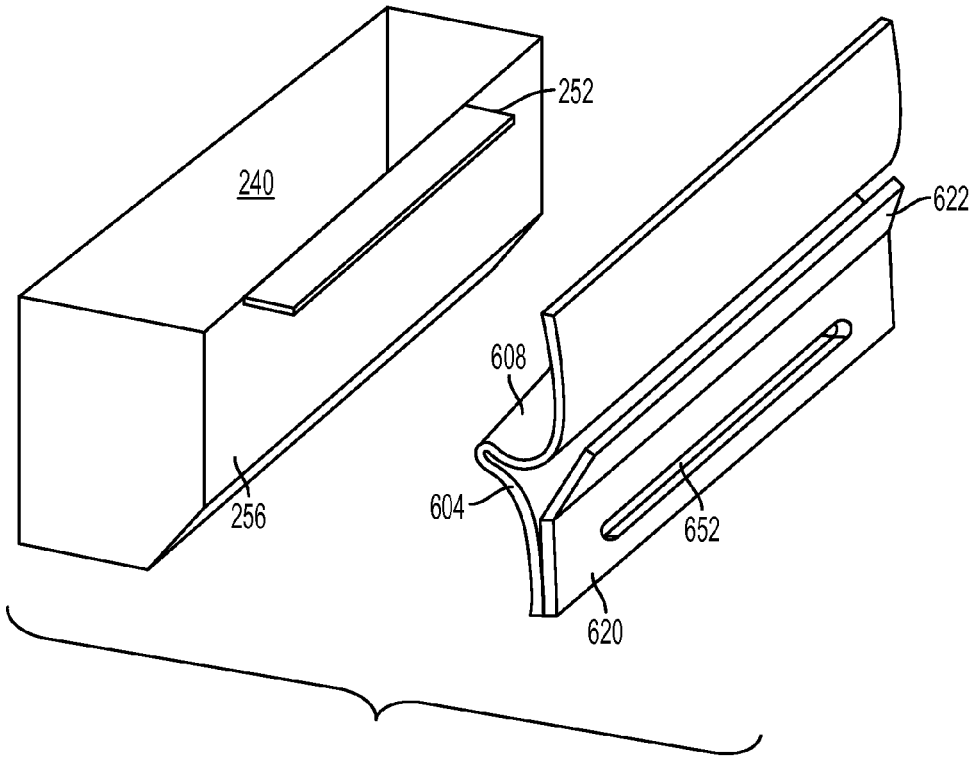
FIG. 7 is a partially exploded view of another embodiment of the flexible member and the ink receptacle in the cleaning unit.

FIG. 7 depicts an alternative configuration of a flexible member 604, which is configured to be affixed to a printhead unit to collect ink drops from a drip bib and empty the ink drops into an ink receptacle 240. In the configuration of FIG. 7, an ink receptacle 240 forms a volume for ink collection with a front wall 256 and a member 252 that projects forward from the front wall at the top of the ink receptacle 240.

A flexible member 604 is formed from a thermally insulating material having a low solid surface energy, such as silicone rubber. The flexible member 604 is shaped to form a gutter 608 that holds ink drops that are released from a drip bib. A striking member 618 includes a lower section 620 that is bonded to the flexible member 604 and a striking section 622 that extends rearward from the flexible member 604. The striking member 618 is a moveable member formed from a resilient material, such as stainless steel, and is configured as a leaf spring in the embodiment of FIG. 7. A slot 652 is formed through both the flexible member 604 and the lower section 620 of the striking member 618. The projecting member 252 of the ink receptacle 240 is configured to fit through the slot 652 when the flexible member 604 engages the ink receptacle 240. As described in more detail below, the striking section 622 of the striking member 618 strikes the flexible member 604 to urge ink into the ink receptacle 240 when the flexible member 604 is engaged with the ink receptacle 240.

Figure 8:
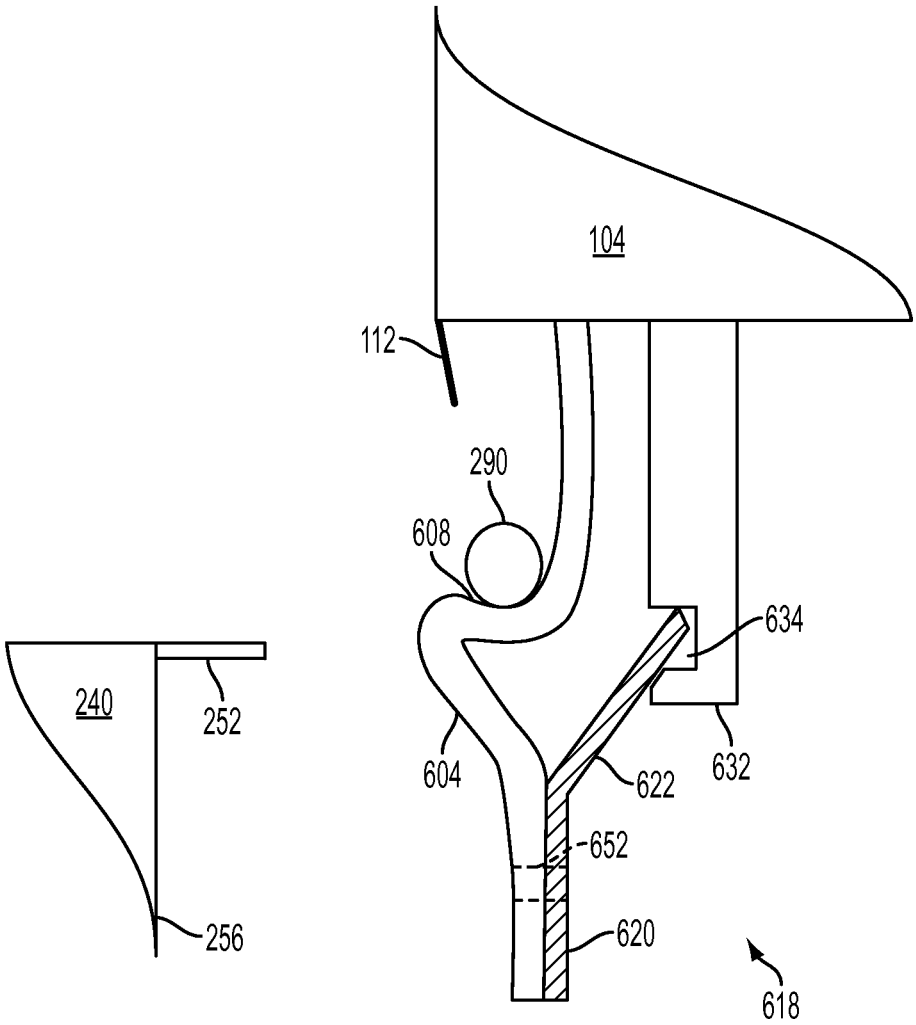
FIG. 8 is a side view of the flexible member of FIG. 7 when a striking member that is affixed to the flexible member engages a catch positioned on the printhead unit.
Figure 9:
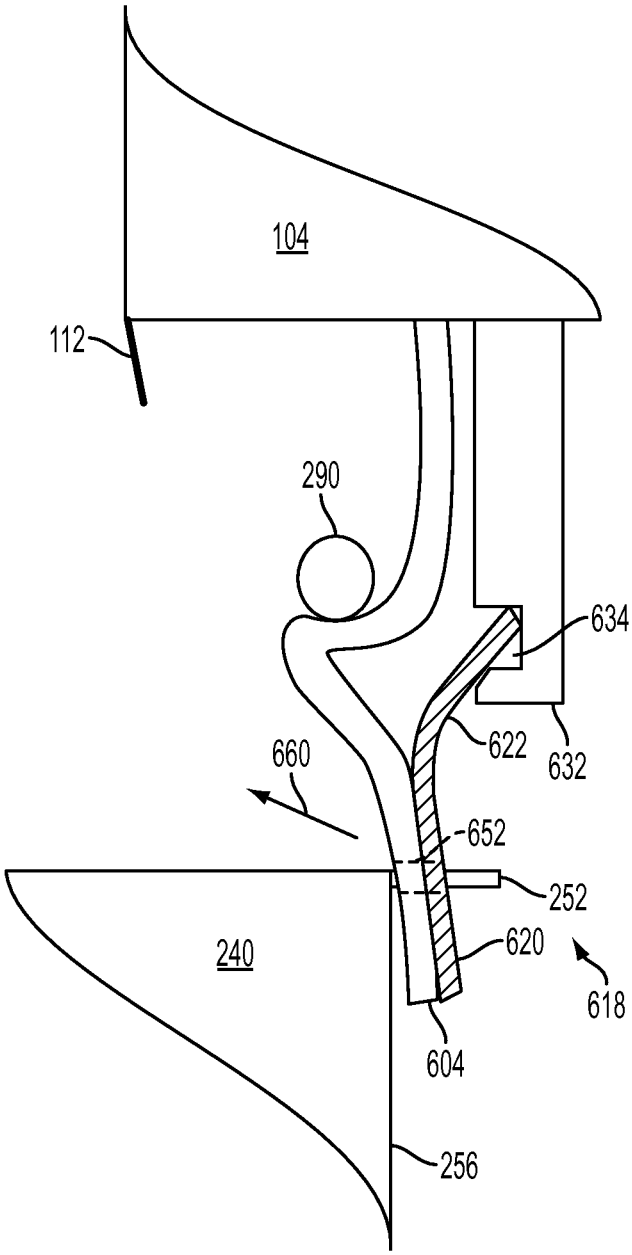
FIG. 9 is a side view of the flexible member of FIG. 7 and FIG. 8 as the flexible member engages the ink receptacle.
Figure 10:
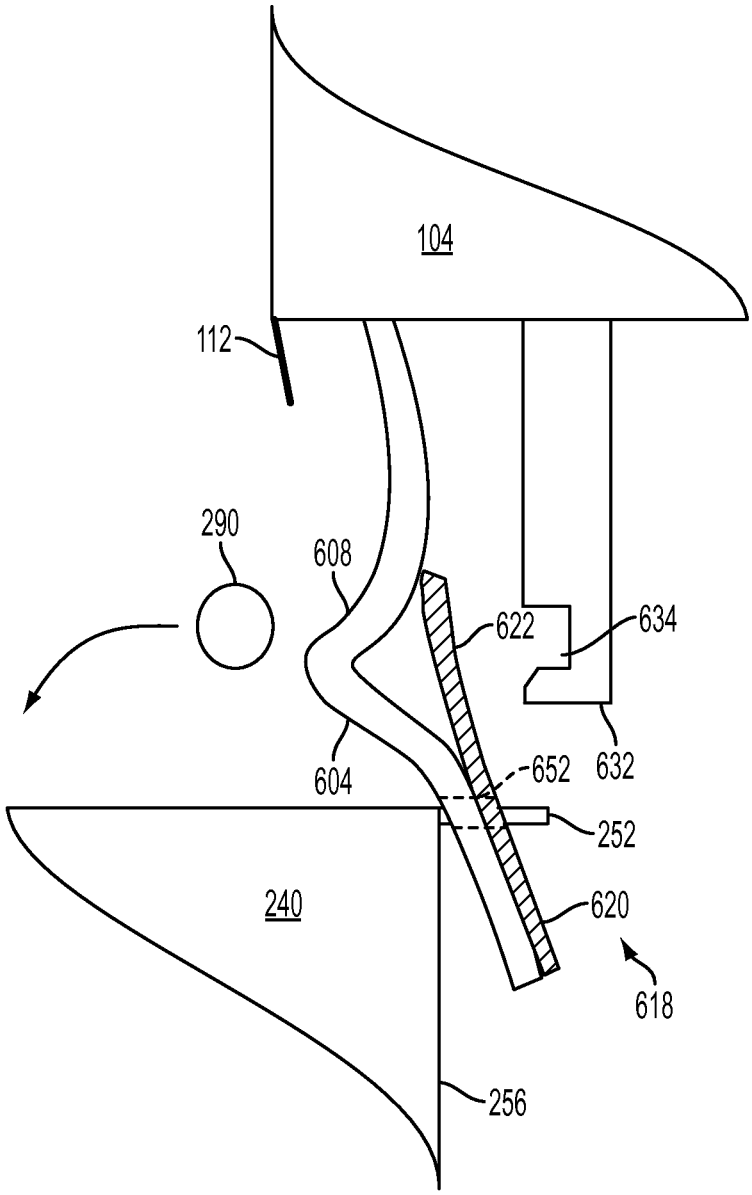
FIG. 10 is a side view of the flexible member of FIG. 7-FIG. 9 as the striking member strikes the flexible member to urge ink from the flexible member into the ink receptacle.

FIG. 8-FIG. 10 depict the flexible member 604 attached to a printhead unit 104 during operation. The printhead unit 104 includes a drip bib 112, and the gutter 608 in the flexible member collects ink drops that are released from the drip bib 112 during imaging operations. The collected ink solidifies in the gutter 608, shown here as solidified ink mass 290. A catch member 632 is affixed to the printhead unit 104 behind the flexible member 604 and striking member 618. The catch member includes a notch 634 that engages the striking section 622 of the striking member 618.

FIG. 8 depicts the printhead unit 104 in a disengaged position from the ink receptacle 240. In the configuration of FIG. 8, the striking member 618 engages the catch 634 with one end of the striking section 622 positioned in the notch 634. In the position depicted in FIG. 8, the striking member 618 is shown in a relaxed position with a minimal amount of potential energy stored in the striking member 618.

FIG. 9 depicts the printhead unit 104 as the printhead unit 104 moves in direction 660 and engages the ink receptacle 240. In the configuration of FIG. 9, the flexible member 604 engages the front wall 256 of the ink receptacle 240. The projecting member 252 also engages the slot 652 to prevent the flexible member 604 from slipping on the front wall 256 of the ink receptacle 240. The force between the flexible member 604 and the ink receptacle 240 deforms both the flexible member 604 and the striking member 618. In particular, the striking section 622 of the striking member 618 bends and stores potential energy. The frictional forces between the catch 632 and the striking member 618 hold the striking section 622 in place as the striking member 618 deforms.

FIG. 10 depicts the printhead unit 104 in a fully engaged position with the ink receptacle 240. In the configuration of FIG. 10, the flexible member 604 is deformed to a greater degree than depicted in the configuration of FIG. 9. In the configuration of FIG. 10, the amount of potential energy stored in the striking member 618 overcomes the frictional forces that engage the striking member 618 to the catch 632, enabling the striking section 622 to release and strike the flexible member 604. The mechanical force of the striking member 622 against the flexible member 604 and the gutter 608 urges the solidified ink 290 out of the gutter 608 and into the ink receptacle 240. Additionally, the flexible member 604 and gutter 608 stretch to urge the solidified ink 290 to enter the ink receptacle 240. After the cleaning process is complete, the printhead unit 104 disengages from the ink receptacle 240 and returns to the configuration depicted in FIG. 8.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art, which are also intended to be encompassed by the following claims.

What is claimed:

1. An ink removal system for a printhead that ejects phase change ink comprising:

a drip bib operatively connected to a printhead at a position below a face of the printhead to enable the drip bib to receive melted ink from the face of the printhead and direct the melted ink downward from the face of the printhead;

a flexible member positioned below the drip bib and configured to receive and capture melted ink dropping from the drip bib and to release the captured ink from the flexible member in response to the flexible member bending;

an ink receptacle configured to move into contact with the flexible member to bend the flexible member and release the captured ink from the flexible member; and a spring operatively connected to the flexible member and configured to return the flexible member to the position beneath the drip bib in response to the ink receptacle moving out of contact with the flexible member.

2. The ink removal system of claim 1, the flexible member being essentially comprised of silicone rubber.

3. An ink removal system for a printhead that ejects phase change ink comprising:

a drip bib operatively connected to a printhead at a position below a face of the printhead to enable the drip bib to receive melted ink from the face of the printhead and direct the melted ink downward from the face of the printhead;

a flexible member positioned below the drip bib and configured to receive and capture melted ink dropping from the drip bib and to release the captured ink from the flexible member in response to the flexible member bending; an ink receptacle configured to move into contact with the flexible member to bend the flexible member and release the captured ink from the flexible member; and a moveable member that is configured to move into and out of contact with the flexible member on a side of the flexible member that is opposite the ink receptacle to facilitate release of the captured ink from the flexible member.

4. A method of holding ink released from a drip bib comprising:

capturing liquid ink released from a drip bib in an inkjet printer in a flexible member positioned below the drip bib;

bending the flexible member; and releasing the captured ink from the flexible member in response to bending the flexible member.

5. The method of claim 4 wherein the flexible member bends in response to moving the flexible member into contact with an ink receptacle and the flexible member releases the captured ink into the ink receptacle.

6. The method of claim 5 further comprising:

bending the flexible member to a second position that is removed from the position below the drip bib;

collecting liquid ink on at least one point of the drip bib; and releasing at least a portion of the liquid ink from the at least one point into the ink receptacle.

7. The method of claim 5 further comprising:

biasing the flexible member to return the flexible member to the position under the drip bib in response to the flexible member moving out of contact with the ink receptacle.

8. The method of claim 7, wherein a spring biases the flexible member.

9. The method of claim 5 further comprising:

moving a member into contact with the flexible member on a side of the flexible member that is opposite the ink receptacle to facilitate release of the captured ink from the flexible member.

10. The method of claim 4 further comprising:

freezing the captured ink in the flexible member.

11. The method of claim 4 further comprising:

holding the captured ink in the flexible member in contact with silicone rubber to prevent the ink from adhering to the flexible member when the flexible member bends.

* * * * *